United States Patent [19]

Tully et al.

[11] Patent Number: 4,837,890

[45] Date of Patent: Jun. 13, 1989

[54] DOOR CLOSER HAVING ARM/SLIDE TRACK CONNECTION

[75] Inventors: Clay E. Tully, Charlotte; Seth D. Perry, Monroe, both of N.C.

[73] Assignee: Yale Security Inc., Monroe, N.C.

[21] Appl. No.: 193,657

[22] Filed: May 13, 1988

[51] Int. Cl.[4] ..... E05F 1/00

[52] U.S. Cl. ..... 16/71; 16/DIG. 17; 292/275

[58] Field of Search ..... 16/49, 51, 66, 71, 72, 16/89, 102, 106, DIG. 9, DIG. 10, DIG. 17; 292/17, 275

[56] References Cited

U.S. PATENT DOCUMENTS

| | | | |
|---|---|---|---|
| 1,732,299 | 10/1929 | Bigland | 16/88 |
| 2,958,089 | 11/1960 | Roehm et al. | 16/49 |
| 3,986,742 | 10/1976 | Heaney | 16/49 X |
| 3,996,642 | 12/1976 | Atkins | 292/275 X |
| 4,287,639 | 9/1981 | Denton | 16/51 X |

FOREIGN PATENT DOCUMENTS

| | | | |
|---|---|---|---|
| 14614 | of 1908 | United Kingdom | 16/88 |

*Primary Examiner*—Fred A. Silverberg
*Attorney, Agent, or Firm*—Dallett Hoopes

[57] ABSTRACT

A door closer is disclosed having an operating arm with a track traveler which mounts a plurality of rollers. The rollers engage between them the opposite sides of a track on the door. The opposite sides of the track each have outward concave faces. The rollers are ball-shaped, conforming to the faces of the track. A door holder is also disclosed which may be adjustably fixed at a position along the track, the traveler and the holder having the mating parts of a snap fastener which, when engaged, hold releasably the door at a fixed hold-open position.

6 Claims, 1 Drawing Sheet

DOOR CLOSER HAVING ARM/SLIDE TRACK CONNECTION

BACKGROUND OF THE INVENTION

1. Field of the Invention

This invention relates to a door closer having an arm with a traveler on its distal end, the traveler engaging a track on the top of the door. More specifically, this invention relates to a door closer having on its arm a traveler with a plurality of ball-shaped rollers engaging opposite concave faces of a track mounted on the top of the door.

2. Description of the Related Art Including Information Disclosed Under §§1.97–1.99

It has been customary in the prior art to provide on the end of a one-piece arm of a door closer a downward shaft journaling a single roller engaging an upwardly-facing track of C-shape cross section. An example is disclosed in U.S. Pat. No. 4,287,639, which issued Sept. 8, 1981 to Arthur M. Denton. Such arrangements, while conventional in the art and which are shown in expired patents, have been known to have drawbacks. Specifically, because the C-shape track is upwardly facing, in bad environments it can accumulate dust and dirt to the extent that such debris becomes encrusted in the track and on the roller and can jam the action of the roller on the track.

SUMMARY OF THE INVENTION

Under the present invention, the door closer is provided on its arm with a downward pin pivotally attached to a cart-like traveler, comprising a platform with a plurality of spaced downward spindles each mounting rotatably a hard plastic ball-shaped roller. The rollers engage opposite sides of the vertical flange of a track having inverted T-shape, the base flange of the track being mounted horizontally on the top of the door and the vertical flange having concave faces on its opposite sides complementing the shape of the ball-shaped rollers.

By virtue of the invention summarized above, the movement of the traveler is not impeded, as has been the case with the single roller track in the past. Encrustations of dirt and other debris do not accumulate in the track. This is because the track arrangement in the present invention is open and any dirt which falls into the track cavity at the top of the door moves on downward past the track and does not accumulate there.

In addition, under the invention summarized above the movement of the traveler along the track is smooth and noiseless. Because the rollers are spaced along the track, the traveler has unusual stability. Also it is capable of longer life, because the forces which have formerly been borne by a single shaft and roller are herein borne by a plurality of rollers.

BRIEF DESCRIPTION OF THE DRAWINGS

Further objects and features of the invention will be apparent from a review of the following specification and the drawings, all of which disclose a non-limiting form of the invention. In the drawings.

DESCRIPTION OF THE PREFERRED EMBODIMENT

Figure 1:
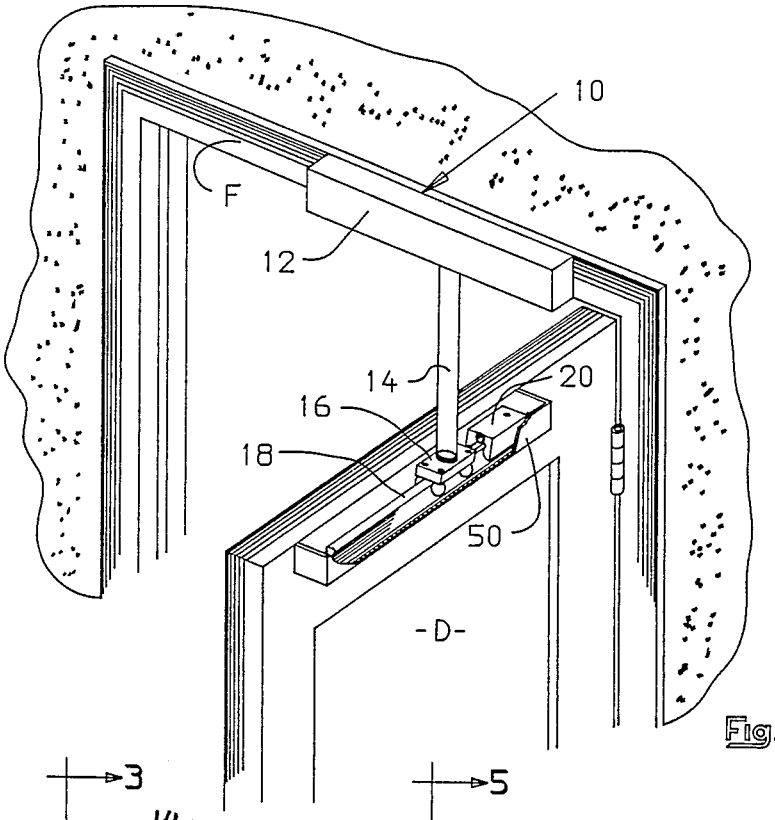
FIG. 1 is a perspective view of the door closer embodying the invention installed on a door. A portion of the angle extrusion which mounts the track is broken away to show the traveler.

Referring to FIG. 1, a door closer embodying the invention is generally designated 10. It comprises a closer operator enshrouded in a housing 12 and having a drive arm 14 mounted on the lower end of its shaft. The housing 12 and its contents are mounted on the door frame F.

Connected to the distal end of the arm 14 is the traveler 16, which engages and moves along the track 18 mounted at the top of the door D. A holder 20, which may be provided if desired or necessary, is mounted on the track toward the hinge end of the door D from the traveler 16. It should be understood that the traveler 16 may be used without the holder and still enjoy many of the benefits of the invention.

While the track 18 may be mounted in a recess along the top of the door with appropriate cutouts in the upper end of the sides of the door to permit the free movement of the arm 14 as the door opens and closes, the arrangement shown is preferred. The track 18 is mounted in a trough formed by an angle 50 secured to the side of the door outward from the frame F (FIG. 1). Specific mounting means for the angle are not shown. End caps may cover the opposite ends of the angle.

Figure 2:
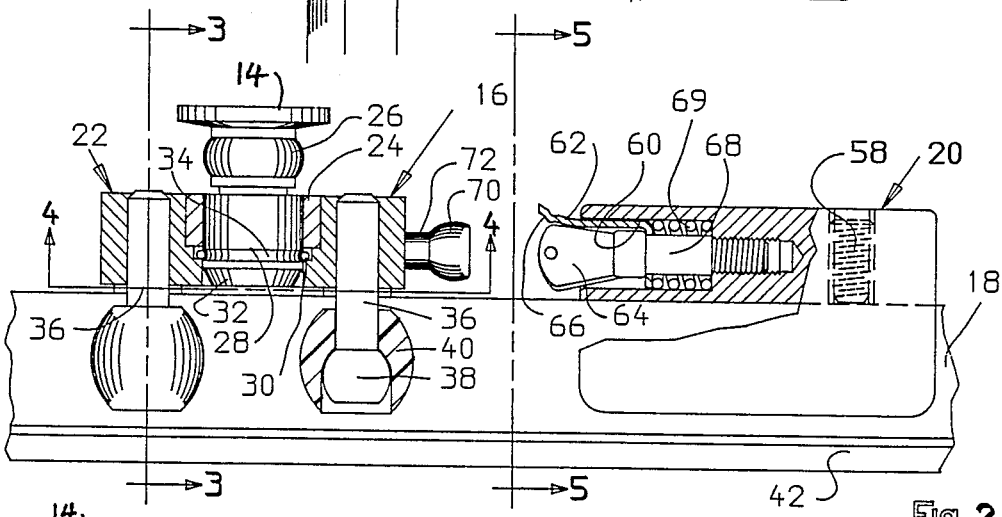
FIG. 2 is an enlarged fragmentary view of the traveler-and-holder assembly mounted on the track.

The traveler 16 (FIG. 2) comprises a platform 22 of rectangular shape (FIG. 4) and is formed with a central opening into which a bushing 24 is pressed. The arm 14 has a downward shaft 26, which includes a cylindrical hub 28 which fits snuggly but rotatably inside the bushing 24. Under the bushing the platform 22 is formed with a recess which receives a retaining ring 30. The lower end of the shaft 26 is formed with a lead-in 32 above which is a groove 34 which cooperates with the retaining ring 30 to hold the platform on the shaft.

Preferably the retaining ring is of spring steel and is split and sized to open slightly to permit entry of the shaft and to snap into the groove 34. The ring, always trapped in the annular pocket beneath the bushing 24, holds the shaft on the platform.

Adjacent its four corners the platform is drilled and fitted with downward spindles 36. The spindles are fixedly mounted on the platform, and at their lower ends are each formed with a spherical head 38. In assembly the spindles each receive a ball-shaped roller 40 having a central stepped opening which, as shown, closely surrounds the spindle in both the area above the head 38 and in the area of the upper half of the head 38, so that the ball is rotatably retained by the head 38 on the spindle.

Preferably the ball-shaped rollers 40 are formed of a tough hard durable plastic with low coefficient of friction and dimensional stability.

The track 18 (FIG. 3) is an inverted T-shape and comprises a base flange 42 having a central upward or vertical flange 44. The opposite faces of the flange 44 are concave, as shown, and complement the shape of the rollers 40. Preferably the track 18 is an aluminum extrusion. The base flange 42 has a central undercut recess 46 running centrally along its length.

Figure 3:
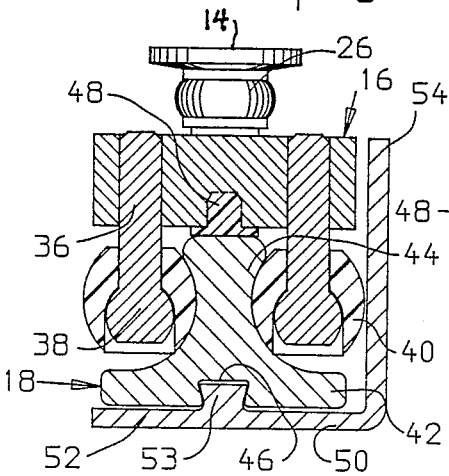
FIG. 3 is a sectional view taken on the line 3—3 of FIG. 2.
Figure 4:
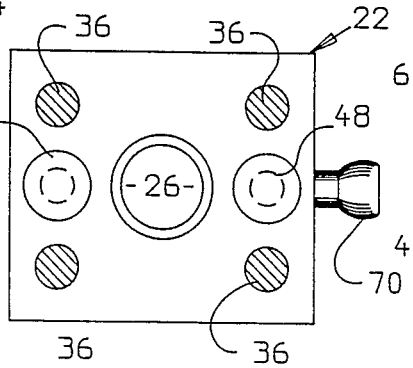
FIG. 4 is a sectional view taken on the line 4—4 of FIG. 2.

As shown in FIGS. 3 and 4, the underside of the platform 22 is drilled in line with the shafts 36 and receives the hard plastic snubbers 48 which ride along the top of the vertical flange 44 of track 18. Between the shape of the rollers 40, cooperating with the concave faces of the flange 44 and the downwardly facing snubbers 48 engaging the top of the flange 44, the platform is held against vertical movement with respect to the track 18 and yet is still free to move smoothly and quietly therealong.

As already described, an angle-shaped extrusion 50 provides the mounting near the top of the door D. The extrusion (FIG. 3) comprises the horizontal flange 52 and vertical flange 54. As shown in FIG. 1 the vertical flange 54 of the angle 50 extends upward and forms a curtain or shield to hide the traveler 16 and track 18 from view.

The horizontal flange 52 is formed with an upward undercut projection 53 which dovetails with the undercut recess 46 in the base flange 42 of the track. Thus, in installation the angle 50 may be secured near the top of the door and the track 42 may be simply slid onto it, being fully secured in any position therealong. The interfitting projection 53 and recess 46 permit the ready replacement of the track if it becomes damaged or replacement is otherwise desired or necessary.

Figure 5:
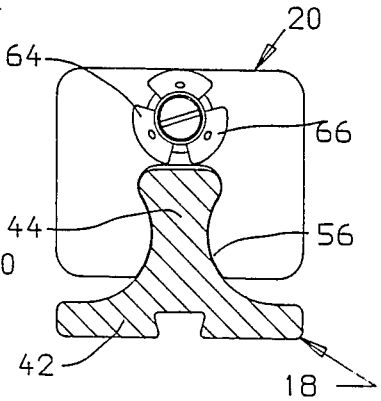
FIG. 5 is a sectional view taken on the line 5—5 of FIG. 2.

The holder 20 (FIG. 5) comprises a block of generally square vertical cross section except for a recess 56, which complements the hour-glass shape of the cross section of the flange 44. The holder 20 is installed on the track, as shown in FIG. 5, and adjacent its rear end it is drilled and tapped and receives a set screw 58 which, when tightened, draws the holder 20 upward, causing the necked-in surfaces of the recess 56 to grab against the upper enlarged portion of the flange 44 and fix the holder 20 in position on the track 18.

In its leftward face (FIG. 2) the holder 20 is provided with a cavity 60 which receives a sheet metal collet 62, which comprises spring jaws 64 which are formed with an outwardly flaring lead-in 66. An adjustment screw 68 adjusts the intensity of the grip of the collet as it compresses the rear of the collet against spring 69.

At the same level as the opening defined by the jaws 64 of the collet the platform 22 has mounted thereon a head 70, which is preferably formed at the end of a threaded shaft 72 screwed into a threaded opening in the end face of the platform.

In operation, as the door is opened, the arm 14 rotates in the same direction as the door, but because of the geometry, the engagement of the arm with the door moves closer to the hinges and the traveler 16 moves along the track 18 accordingly. As the door is more fully opened, the traveler approaches the holder 20 so that at the opening limit of the door, the head 70 engages in the collet 64 and snaps thereinto, holding the door in that open position. The position of the holder 20 on the track 18 can be adjusted along the track to the desired position so that the door stops at the desired hold-open position.

The arrangement heretofore described provides a traveler for the arm of the door closer which permits smooth and quiet travel along the shaped track 18 and, because of its position above the top end of the door, permits dirt and other debris to fall away from the track so as to not interfere with the operation of the traveler.

It should be understood that variations of the invention as described are possible and that only the preferred embodiment has been disclosed. Because there are many variations and re-designs possible, the invention is not limited except by the scope of the following claim language and fair equivalents thereof.

We claim:

1. A door closer of the type that is mounted above a door on a door frame associated with the door and having a single-piece arm extending out from a drive shaft associated with the closer, the arm having a downward pin remote from the drive shaft, a carriage/track assembly secured to the pin comprising:

(a) a straight extruded track adapted to be mounted along the top of the door, the track being formed with a base flange and an upward flange, the upward flange being concave on both of its sides and formed with an enlarged head running along its top;

(b) a traveler comprising a platform slidingly supported on the top of the track and having a central opening receiving the pin on the arm, the platform having at least two downward spindles, each spindle having rotatably secured thereon a hard plastic spherical roller shaped in its outer contour to complement the shape of the adjacent concave portion of the upward flange, the spindles positioned so that the rollers snugly engage the upward flange, one on each side of the track, the lower end of the spherical rollers being spaced above the base flange to permit the passage therebetween of any foreign materials.

2. A door closer as claimed in claim 1 further including a holder adjustably secured at a selected location along the track, the holder and the platform mounting respectively in alignment a head and an aligned socket, whereby when the traveler reaches the holder, the head and socket interengage and the door is held open until some closing force in addition to the force of the closer overcomes the holding action of the head and socket.

3. A door closer as claimed in claim 1 wherein there are a pair of spindles and rollers engaging each side of the upward flange.

4. A door closer as claimed in claim 1 wherein the lower end of the spherical rollers are truncated off to present a surface spaced well above the base flange.

5. A door closer as claimed in claim 1 wherein the underside of the platform is provided with snubbing means which engage the top of the upward flange of the track to support the platform.

6. A door closer of the type that is mounted above a door on a door frame associated with the door and having a single-piece arm extending out from a drive shaft associated with the closer, the arm having a downward pin remote from the drive shaft, a carriage/track assembly comprising:

(a) a straight extruded track adapted to be mounted along the top of the door, the track being formed with a base flange and an upward flange, the upward flange being concave on both of its sides;

(b) a traveler comprising a platform having means attaching the platform to the pin, the platform having two pairs of downward spindles, each spindle having rotatably secured thereon a ball-shaped roller shaped in its outer contour to complement the shape of the adjacent concave portion of the upward flange, the rollers in each pair opposing each other from opposite sides of the upward flange and engaging said upward flange, the lower ends of each of the ball-shaped rollers being spaced above the base flange to permit the free passage therebetween of any foreign materials.

* * * * *